United States Patent [19]

Woltman

[11] Patent Number: 4,726,134

[45] Date of Patent: Feb. 23, 1988

[54] ROADWAY SIGN

[75] Inventor: Henry L. Woltman, Afton, Minn.

[73] Assignee: Minnesota Mining and Manufacturing Company, St. Paul, Minn.

[21] Appl. No.: 933,739

[22] Filed: Nov. 21, 1986

[51] Int. Cl.[4] ..... G09F 13/16

[52] U.S. Cl. ..... 40/582; 350/103; 40/612; 40/615; 40/454

[58] Field of Search ..... 350/103; 40/584, 615, 40/612, 454

[56] References Cited

U.S. PATENT DOCUMENTS

| | | | |
|---|---|---|---|
| 285,270 | 9/1883 | Jaeger | 40/582 |
| 1,751,984 | 3/1930 | Eskilson | 40/582 |
| 2,022,639 | 11/1935 | Stimson | 350/103 |
| 2,043,414 | 6/1936 | Korf | 40/612 |
| 2,326,634 | 8/1943 | Gebhard et al. | 88/82 |
| 2,910,792 | 11/1959 | Pfaff | 40/582 |
| 3,712,706 | 1/1973 | Stamm | 350/103 |
| 4,215,501 | 8/1980 | Meijer | 40/582 |
| 4,588,258 | 5/1986 | Hoopman | 350/103 |

*Primary Examiner*—Gene Mancene
*Assistant Examiner*—Wenceslao J. Conteras
*Attorney, Agent, or Firm*—Donald M. Sell; James A. Smith; Robert H. Jordan

[57] ABSTRACT

An improved roadway sign comprising a light retroreflective indicia region and colored retroreflective background region is provided. The retroreflective properties of the regions are selected such that the ratio of the retroreflective brightness of the indicia to that of the background is substantially larger at observation locations within the legibility zone for the sign, than the ratio is at observation locations outside the legibility zone. The sign is conspicuous by virtue of the bright retroreflection and distinctive color of the background outside the legibility zone, yet is legible because of the increased contrast ratio of the indicia to the background in the legibility zone.

9 Claims, 6 Drawing Figures

400
300
200
100
50
40
30
20
10
5
2
0
.1
.2
.5
1.0
40
38
III
IV
V

ROADWAY SIGN

FIELD OF INVENTION

This invention relates to an improved roadway sign which is visible at night at great distances to occupants of approaching vehicles, i.e., has high conspicuity, and which is also easily read upon approach, i.e., has high legibility.

BACKGROUND

Roadway signs, such as highway signs, markers, advertising displays, etc., have long been constructed using retroreflective sheetings. Retroreflective sheeting reflects incident light rays substantially back toward the source as a cone of light. Thus the light emitted by headlights of a motor vehicle toward a sign constructed with such sheeting will be reflected back toward the vehicle so as to be visible to the occupants of same.

In practice, retroreflective sheetings were typically first employed in roadway signs in the background portions of the sign, with the sheeting being cut out around raised indicia, or being selectively covered, e.g., painted, to produce same. Thus an occupant of an approaching vehicle would first detect the sign's background, and upon close approach, the indicia would become legible due to the contrast of brightness and color between the indicia and background. Such a sign is disclosed in U.S. Pat. No. 2,326,634 (Gebhard et al.) which relates to the retroreflective brilliancy of microsphere-based sheeting and the relationship of the refractive index of the microspheres thereto.

Roadway signs can also be constructed from cube-corner retroreflective sheetings such as disclosed in U.S. Pat. No. 3,712,706 (Stamm) which discloses such sheetings and methods for preparing the same.

Recent constructions employ retroreflective sheeting in both the background region and indicia region. Such combinations typically provide increased long range detectability and recognizability, i.e., conspicuity, to the sign. Legibility is typically provided by coloring one region to provide color contrast, typically resulting in a ratio of retroreflective brightness, i.e., contrast ratio, that is substantially constant over the intended observation distances. For instance, white or silver sheeting may be used as the indicia and green colored sheeting as the background, such as is commonly seen along the interstate highway system in the United States. Such signs typically have a substantially constant contrast ratio of about 5:1 to 6:1, i.e., the indicia region is brighter than the background region by the stated ratios.

A problem with some roadway signs is that they may be difficult to read at night because very bright retroreflection by the background tends to wash out or obscure the indicia, rendering same difficult to see. Thus the maximum brightness of the background which may be achieved tends to be limited by the degree to which it reduces the legibility of the sign, and the maximum legibility which may be achieved tends to be reduced by the degree to which contrast of the indicia with the background is reduced.

SUMMARY OF INVENTION

This invention provides an improved roadway sign comprising light, e.g., white or silver, retroreflective indicia and a colored, e.g., green, red, or blue, retroreflective background which provides the surprising combination of improved legibility, i.e., the information contained thereon is more easily read, and also improved conspicuity, i.e., the sign is more readily detected and recognized.

The advantages of this invention are achieved by separately, but cooperatively, optimizing the retroreflective properties of the retroreflective material employed in the background region and of the retroreflective material employed in the indicia region. Such materials will be referred to herein as sheetings, perhaps the most common form of such retroreflective material, but other retroreflective materials, e.g., paints, which provide the desired properties as discussed below are intended to be incorporated within the term "sheeting". The retroreflective sheeting employed in the background area is selected to have maximum retroreflective efficiency at small observation angles which correspond to long observation distances beyond where the sign can be read, but where it is intended to be detected and recognized (referred to herein as conspicuity zones as defined below); and to have relatively lower retroreflective efficiency at larger observation angles which correspond to short observation distances near the sign where it is intended to be read (referred to herein as legibility zones as defined below) The retroreflective sheeting employed as the indicia, meanwhile, is selected to have high retroreflective efficiency at the larger observation angles which correspond to short observation distances within the legibility zone for the sign. Thus the two areas of the sign are utilized cooperatively: at great distances, i.e., small observation angles, the background provides bright retroreflection, thereby effectively using the typically large background area of the sign to increase its conspicuity, rendering the sign easier to detect because of its increased retroreflective brightness, and easier to recognize because of its distinctive color; and at shorter distances, i.e., reletively greater observation angles, the contrast ratio of the indicia area to the background area becomes greater, thereby improving legibility of the information displayed on the sign.

In brief summary then, the invention provided herein is a sign, such as a highway sign or marker, comprising a colored background region and a light indicia region, each of which has a retroreflective covering. The retroreflective coverings on each region are selected such that the ratio of retroreflective brightness between the indicia and the background is substantially larger at larger observation angles corresponding to locations within the legibility zone for the sign than such ratio is at smaller observation angles corresponding to more distant locations. By substantially larger it is meant that the contrast ratio in the legibility zone is at least 25 percent greater than the contrast ratio in the conspicuity zone, i.e., if the contrast ratio is 4:1 in the conspicuity zone then it will be at least 5:1 in the legibility zone. Preferably the contrast ratio is at least 50 percent greater in the legibility zone than in the conspicuity zone to ensure that a large proportion of the population can discern the improvement in legibility. Such change in the contrast ratio may be achieved by: (1) employing retroreflective sheeting in the background which tends to reflect relatively less light when viewed from the legibility zone than the conspicuity zone; (2) employing retroreflective sheeting in the indicia region which tends to reflect relatively more light when viewed from the legibility zone than from the conspicuity zone; or (3) combination of both such actions.

Accordingly, as an automobile approaches a sign as provided herein the sign will retroreflect light incident thereto from the automobile as follows. Upon initial approach, at long distances the sign is easily detected and recognized, i.e., is conspicuous, because of the bright retroreflection of the background, in concert with whatever retroreflection is provided by the indicia at that distance. However, as the car continues its approach and enters the legibility zone, the ratio of retroreflective brightness between the indicia and background is substantially increased such that the legibility of the indicia is improved. Thus, surprisingly, this invention provides means for achieving in one sign both high conspicuity and high legibility, thereby improving the overall performance of a roadway sign in a manner heretofore unavailable because of the seemingly mutually exclusive nature of these two performance criteria.

BRIEF DESCRIPTION OF DRAWING

The invention is further explained with reference to the drawing wherein.

These figures, intended to be merely illustrative, are not to scale and are intended to be nonlimiting.

DETAILED DESCRIPTION OF INVENTION

Roadway signs are typically located on or near the shoulder of a roadway, or over the roadway, substantially facing and in the line of sight of oncoming traffic such that the occupants of such vehicles may read the information thereon, e.g., directional information, distances to destinations, or traffic control instructions.

Figure 1:
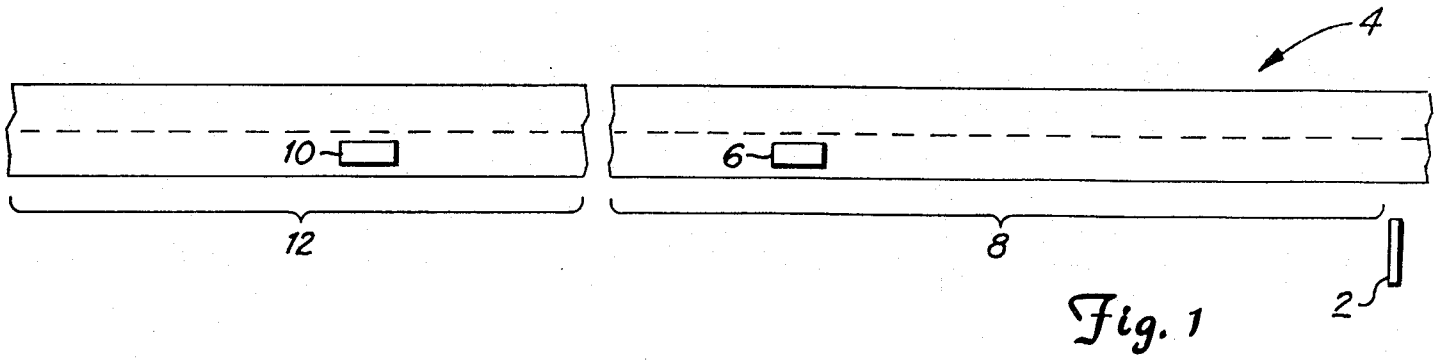
FIG. 1 is a schematic view showing the relationship between the legibility and conspicuity zones as defined herein.

The region in the line of sight of oncoming traffic approaching a sign, beginning at the point at which the indicia thereon can first be read by persons having normal visual acuity, i.e., 20/20 vision, and extending to the sign, is defined herein as the legibility zone. Referring to FIG. 1, sign 2 is shown mounted on the shoulder of road 4. Car 6, which is approaching the sign, is in the legibility zone 8, i.e., the indicia (not shown) on the sign 2 are capable of being read by the occupants (also not shown) of car 6. The precise magnitude of such a zone will depend in part upon the size and style of characters displayed as indicia upon the sign. The following table illustrates the typical maximum distance at which characters of the indicated size and style are considered legible to persons having normal visual acuity, i.e., 20/20 vision.

TABLE 1

| Letter Height (inches) | Series C[1] (feet) | Series E-Modified[1] (feet) |
|---|---|---|
| 4 | 160 | 240 |
| 8 | 320 | 480 |
| 16 | 640 | 960 |

[1]Standard Alphabet For Highway Signs And Pavement Markings. United States Department of Transportation, Federal Highway Administration, Office of Traffic Operation.

The conspicuity zone is defined herein as the region in the line of sight of oncoming traffic which is beyond the legibility zone. In this zone the sign is to be detected and recognized upon initial approach by a motor vehicle. The purpose and meaning of a roadway sign is typically imparted by the color of the background and its brightness, particularly in the conspicuity zone. As may be understood, the magnitude of the conspicuity zone will also depend in part upon the size and style of the characters displayed as indicia. Also, the magnitude of the conspicuity zone will further depend in part upon the retroreflective brightness of the sign, with brighter signs having longer conspicuity zones. Car 10 in FIG. 1 illustrates a vehicle within the conspicuity zone as defined herein, such zone being designated by bracket 12.

Figure 2:
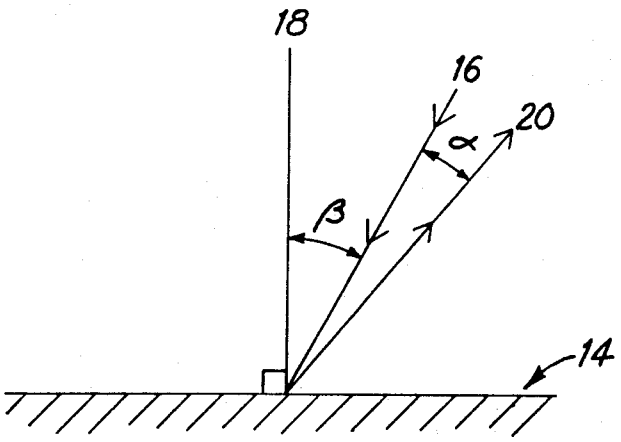
FIG. 2 illustrates the nature of retroreflection.

Reference is now made to FIG. 2 which is a diagram used to illustrate the nature of retroreflection. Shown therein is retroreflective surface 14, a retroreflective surface being defined as one which reflects a substantial portion of the light incident thereon substantially back toward the source. A ray or pencil of rays of light 16 is shown coming from a distant source such as a vehicle headlight (not shown) and impinging upon the retroreflective surface 14 at an entrance angle, $\beta$ (the angle between the incident ray 16 and the normal 18 to the surface 14). If an ordinary mirror were used, producing specular reflection, the emergent or reflected rays would leave the reflector at the same angle but on the opposite side of the normal. If a diffusing surface were used, emergent or reflected rays would go off indiscriminately in all directions and only a small fraction would return toward the source. However, with retroreflection, there is a directional reflection by the retroreflective lens elements, e.g., microsphere-based elements or prismatic cube corners, which are interposed over the retroreflective surface, such that a cone of brilliant light is returned toward the source, the axis of the cone being substantially the same as the axis of the incident ray or pencil of rays 16. By "cone of brilliant light," it is meant that the intensity of light within the cone is greater than would be the case where diffuse reflection occurs. This may hold true only where the entrance angle $\beta$ of the light does not exceed a certain value, depending upon the particular type of retroreflective surface which is used.

That the retroreflection is in the form of a cone is critical because of the fact that the eye of the observer is seldom on the axis of incident light. Thus in the case of an automobile approaching a highway sign, there will be an angle between any given ray of incident light (approaching the sign from the headlights) and the reflected rays reaching the driver's eyes. Hence if the retroreflective surface is perfect in directional action, with incident light being returned only toward its source, it would have little or no utility as a sign. There should be an expansion or coning out of retroreflected light rays in order that persons near, but off, the axis of the incident light may take advantage of the characteristic of the reflector or sign, but this expansion should not be excessive or the reflective brightness will suffer through diffusion of light outside the useful range. The expansion results from the deviation of light rays emergent from the retroreflective surface along the axis of incident light. The deviation of a particular ray 20 which is visible to an occupant of the car whose headlight emitted the pencil of light rays 16 is illustrated in FIG. 2. The acute angle between the incident ray 16 and the emergent ray 20 is thus designated as the observation angle $\alpha$.

Figure 3:
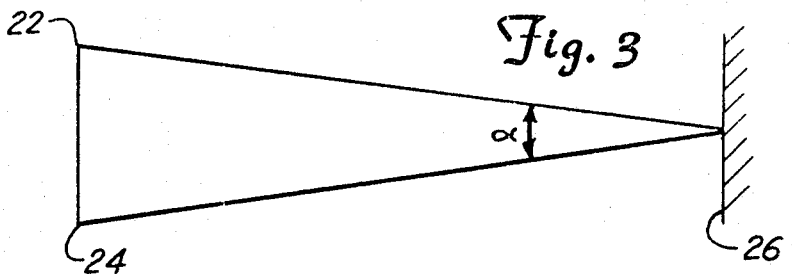
FIG. 3 illustrates the geometry of retroreflection as employed in a roadway sign.

As may be understood, the observation angle is very small at long distances, typically being on the order of 0.1° for a typical automobile at a distance of about 1200 feet. As the vehicle approaches the sign, the observation angle increases. This is illustrated with reference to the triangle diagram of FIG. 3. The distance between driver's eyes 22 and headlight 24 is essentially constant whereas the distance between either of those elements to sign 26 decreases as the vehicle approaches the sign, thereby increasing the observation angle $\alpha$. Thus, as an automobile approaches to a distance of approximately 400 feet from the sign, the observation angle typically increases to about 0.3°. The observation angle for the left headlight will typically not be precisely equal to that of the right headlight because of variations in the parameters illustrated in FIG. 3. The left headlight is the predominant contributor of light reflected so as to be visible to the driver of a typical automobile by virtue of its relative proximity to the driver, therefore, for clarity, the observation angles discussed herein are based upon the left headlight. However, the general principles discussed herein apply to the right headlight as well.

Figure 4:
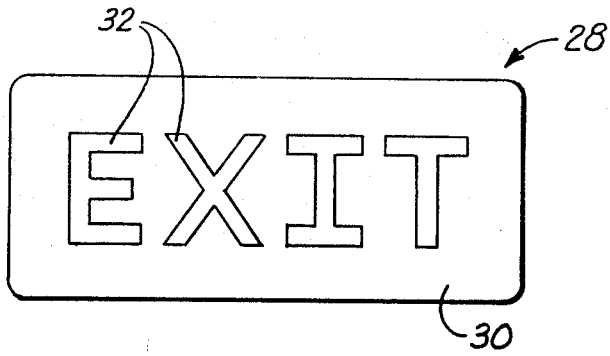
FIG. 4 is a plan view of a sign of the invention.

FIG. 4 illustrates an exemplary highway marker 28 wherein this invention may be applied. The sign 28 comprises two regions, a background 30 and indicia 32.

Figure 5:
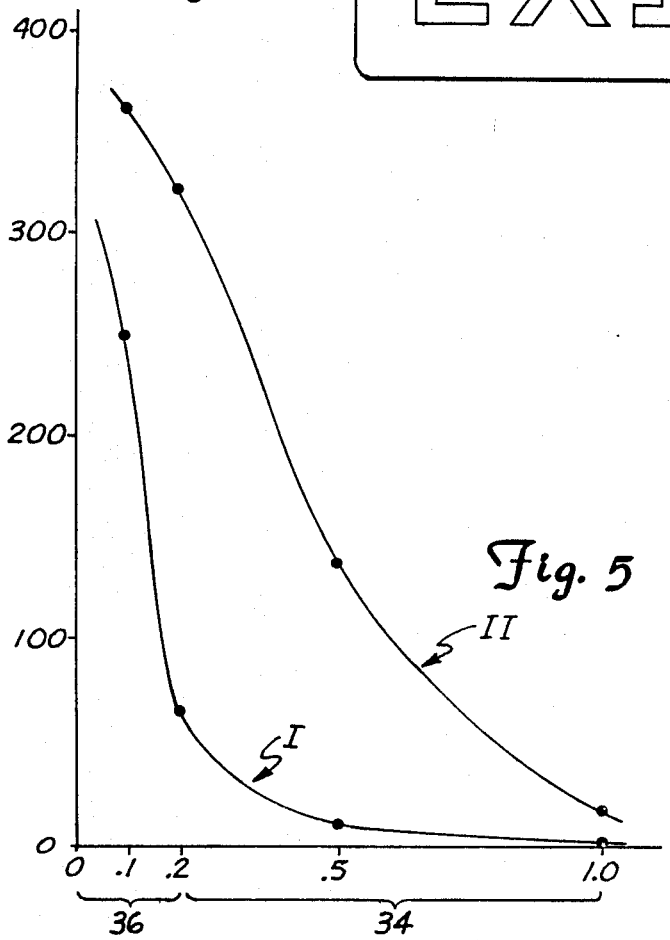
FIG. 5 is a graphical illustration of the relative retroreflective brightnesses of the indicia and background of one embodiment of the invention at different observation angles.

FIG. 5 is a graphical illustration of the retroreflective brightnesses of the indicia region and background region as a function of observation angle for a preferred embodiment of a sign fabricated according to the invention, i.e., the observation angle profiles of the retroreflective sheetings used thereon. The vertical axis represents the retroreflective response in candelas/lux/square meter, and the horizontal axis represents the observation angle in degrees. These observation angle profiles illustrate the relationship between the retroreflective brightness of the indicia and the retroreflective brightness of the background.

According to the invention, each region of a sign will be covered with retroreflective sheeting or other suitable retroreflective material. The background region is provided by a colored retroreflective sheeting having high, preferably very high, retroreflective brightness at small observation angles, i.e., those which correspond to observation of the sign from long distances, but which generally declines substantially in retroreflective efficiency as the observation angle increases beyond a threshold which corresponds to the desired legibility zone. The precise observation angle, and distance from the sign which corresponds thereto, at which such decline in retroreflection is desired will depend upon the magnitude of the legibility zone as discussed above. FIG. 5 illustrates the retroreflective response of such sheeting in curve I. Preferably the retroreflective brightness of the background will decrease substantially in the legibility zone. Observation angles which correspond to a typical legibility zone for a roadway sign are indicated by bracket 34. Bracket 36 indicates observation angles which correspond to a typical conspicuity zone. Examples of retroreflective sheetings which may be useful in the background in a particular embodiment of this invention include available prismatic retroreflective sheet materials which have narrow observation angle profiles.

The indicia region(s) of a sign manufactured according to the teaching herein are provided by a retroreflective sheeting wherein the retroreflective effeciency is substantially retained or declines relatively more slowly throughout the observation angles encountered in the legibility zone as compared to the decline in retroreflective response in such zone of the sheeting employed in the background. Sheeting may also be provided which increases in retroreflective efficiency at higher observation angles. The retroreflective performance of a representative sheeting used in the indicia region(s) is illustrated by curve II in FIG. 5. Examples of microlens-based retroreflective sheetings which may be useful in the indicia in a particular embodiment of this invention include several SCOTCHLITE Brand High Intensity Grade and Engineer Grade Retroreflective Sheetings available from the Minnesota Mining and Manufacturing Company ("3M").

A preferred sign manufactured according to the invention will have the following properties. At great distances, i.e., typically one-quarter mile or more, the light emitted by the headlights of an approaching motor vehicle will be visible to an occupant of the vehicle at a narrow observation angle, i.e., typically 0.1° or less, corresponding to 36 in FIG. 5. At such distances, and the observation angles there encountered, the sheeting employed in the colored background of the sign provides bright retroreflection enabling the easy detection and identification of the sign, i.e., the sign is conspicuous. Upon closer approach, i.e., typically to distances of one-eighth mile or less, however, the observation angle increases to 0.2° or more, corresponding to 34 in FIG. 5. At such observation angles, the indicia have a retroreflective efficiency which should be substantially greater than that of the background, and which is preferably several times that of the background, i.e., which preferably provides a retroreflective brightness ratio of at least 6:1, and more preferably at least 10:1, thereby improving the legibility of the information carried on the sign. The contrast ratio should generally be less than 40:1, however, in order that the background color will remain discernable, thereby aiding in recognition of the sign and its intended purpose by a viewer.

Figure 6:
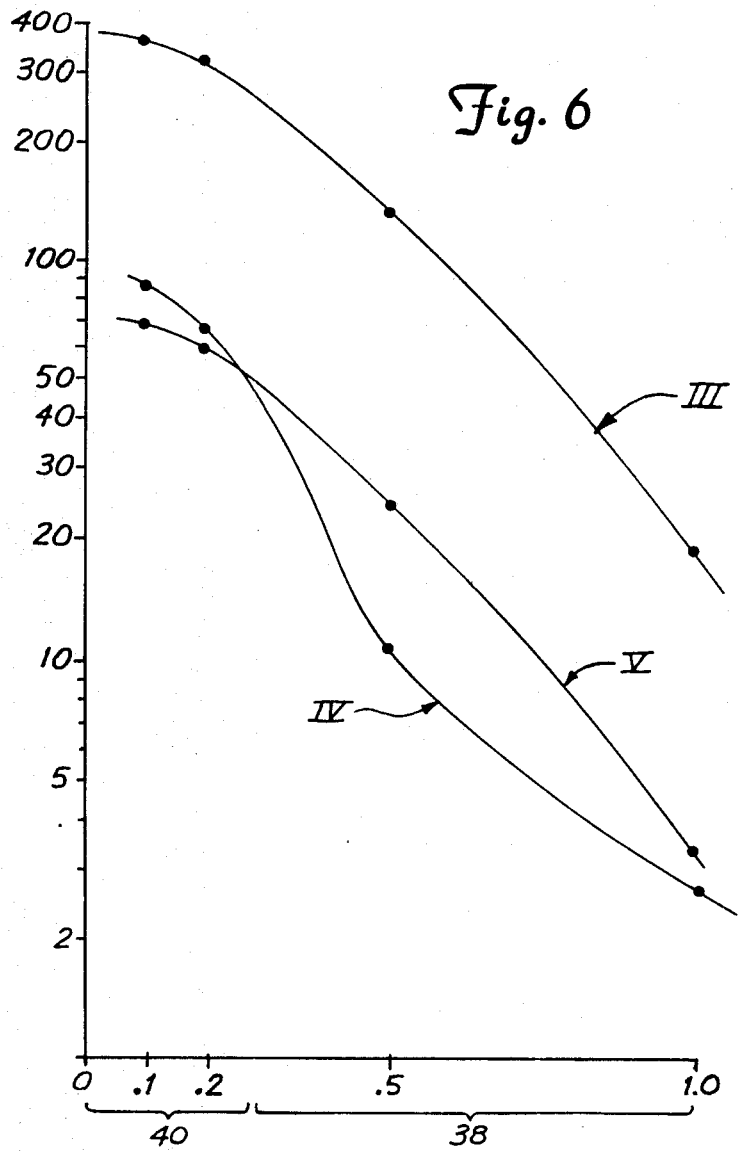
FIG. 6 is a graphical illustration of the relative retroreflective brightnesses of indicia region and background region comparing an illustrative embodiment of the invention and a prior art sign.

FIG. 6 is a graphical illustration of the observation angle profiles for an illustrative embodiment of the invention and a sign fabricated according to the prior art. The vertical axis represents the retroreflective response in candelas/lux/square meter, and the horizontal axis represents the observation angle in degrees. In that figure, curve III represents the observation angle profile for the indicia, curve IV represents that of the background according to the invention, and curve V represents that of the background of a sign fabricated according to the prior art. Bracket 38 represents observation angles corresponding to the legibility zone and bracket 40 represents observation angles corresponding to the conspicuity zone. As can be seen in the figure, the retroreflective brightness of the indicia and background in a sign fabricated according to the prior art decline so as to yield a substantially constant contrast ratio of about 5.2 to 5.7 as the observation angle increases according to the automobile's approach from the conspicuity zone 40 to the legibility zone 38. Contrarily, the retroreflective brightness of the background of a sign fabricated according to the embodiment of the invention illustrated here declines more sharply, so as to provide an increase in the contrast ratio from about 4.2 at 0.1° in the conspicuity zone 40 to about 12.4 at 0.5° in the legibility zone 38, thereby increasing the legibility of the indicia on such sign.

The invention will be further illustrated by the following illustrative examples wherein Signs 1, 2, and 3, which were fabricated according to the disclosure herein, were evaluated in comparison with Comparative Sign A, which was fabricated according to prior art techniques. Each sign was rectangular, 18 inches high and 72 inches wide, with white copy on a green background. The copy on each sign spelled the legend "DUNLAP" with an 8 inch high, 1 9/16 inch stroke width "D" and 6 inch high, 1⅛ inch stroke width remaining letters, all in upper case, i.e., capitalized, form. Each sign also had ¾ inch white border on all four sides.

Unless otherwise indicated, in a one-inch-diameter area, the retroreflective brightness of each micro-cube corner sheet material was measured with a retroluminometer similar to that described in Defensive Publication U.S. Pat. No. T987,003 at an entrance angle of −4°, at a constant presentation angle of 0°, over a range of rotation angles from 0° to 360°, and at the indicated observation angles. The brightness of the high intensity sheet materials were measured according to ASTM Test Method E-810 at an entrance angle of −4°. Brightnesses of each sheeting at observation angles of 0.1° and 0.5° are tabulated in Table 3 below.

The signs were compared in pairs as follows. Two signs were mounted over the other, as right side shoulder mounts on a straight test road. The center of each sign was 10 feet to the right of the shoulder of the road. The center of the bottom sign was about 8 feet above the ground and the center of Comparative Sign A was about 10.5 feet above the ground in each example.

In each example, the signs were viewed at night under dark conditions from two passenger cars (1986 Lincoln Town Cars) approaching in the lane adjacent to the shoulder with low beams on. Eleven persons, seated in various positions in the cars, were asked to rank each sign for comparative brightness and legibility.

COMPARATIVE SIGN A

Sign A was fabricated using SCOTCHLITE Brand 3870 High Intensity Grade Retroreflective Sheeting, a silver/white encapsulated-lens retroreflective sheeting available from the Minnesota Mining and Manufacturing Company ("3M") for the copy and border, and SCOTCHLITE Brand 3877 High Intensity Grade Retroreflective Sheeting, a green encapsulated-lens retroreflective sheeting also available from 3M for the background. The 3870 sheeting had a retroreflective brightness of about 362 candelas/lux/square meter at an observation angle of 0.1°, 322 at 0.2°, 137 at 0.5°, and 19.4 at 1.0°. The 3877 sheeting had brightnesses of about 69, 61, 24, and 4, respectively. These materials are typical of those presently used to make signs for interstate highways in the United States.

EXAMPLE 1

In Example 1, Sign 1 was compared with Comparative Sign A.

Sign 1 was fabricated also using SCOTCHLITE Brand 3870 High Intensity Grade Retroreflective Sheeting for the copy and border.

The background was made from a micro-cube corner material consisting of a green polymethyl methacrylate film bonded to a cube corner embossed polycarbonate film (of the type disclosed in U.S. Pat. No. 4,588,258 (Hoopman)) with a white heat-sealable polyester film bonded to the tips of the cube corners. The green film was 3 mils thick, and had a color measured as $x=0.142$, $y=0.468$, and $Y=19.2$ when overlaid on a white plaque on a HunterLab Labscan II spectrophotometer with illuminant D65. The cube corner film was 20 mils thick and the polyester sealing film was 0.75 mils thick. The cube corners had groove angles of 88.943°, 60.667°, and 60.681°, symmetrical groove side angles, and groove spacings of 16 mils between the 60.667° and 60.681° grooves and 13.948 mils between the 88.943° grooves. The groove side angle is the angle between the groove side and a plane extending parallel to the length of the groove and perpendicular to the plane defined by the bottom edges of the three intersecting sets of V-shaped grooves. The base plane of the cube-corner elements of the sheetings of this example (i.e., the triangle defined by the three intersecting sets of grooves) had included angles of 70°, 55°, and 55°, which is dictated by the degree of tilting of the cube-corner elements as taught in U.S. Pat. No. 4,588,258. The sheetings were prepared by grooving a master, forming a nickel electroform mold, and molding sheeting from polycarbonate.

The background had a retroreflective brightness of 350 candelas/lux/square meter at a 0.2° observation angle, 35 at 0.5°, and 4.8 at 1.0° as measured with an Advanced Retro Technology Model 930 retrophotometer at a 5° incidence angle. A transluscent polyester film was placed over the green film to reduce the brightness of the sheeting. Overlay of the polyester film yielded a sheeting brightness of 86 candelas/lux/square meter at 0.1°, 68 at 0.2°, 11 at 0.5° and 2.3 at 1.0°, as measured according to the Defensive Publication referred to above.

EXAMPLE 2

In Example 2, Sign 2 was compared with Comparative Sign A.

Sign 2 was fabricated similarly as sign 1 except a polyester overlay of different translucency was used on the background sheeting. The sheeting had a brightness of 149 candelas/lux/square meter at 0.1°, 115 at 0.2°, 18 at 0.5°, and 3.3 at 1.0°.

EXAMPLE 3

In Example 3, Sign 3 was compared with Comparative Sign A.

Sign 3 was fabricated using two different micro-cube corner sheetings of the general type described in U.S. Pat. No. 4,588,258 (Hoopman). The array of cube-corner retroreflective elements in the sheeting are defined by three intersecting sets of parallel V-shaped grooves which form a dense or fully packed array of elements. The groove side angles in the sheetings were such that the dihedral angles formed at the lines of intersection of the grooves varied slightly from the orthogonal (i.e., 90°) intersection of a common cube-corner retroreflective element. The variation occurred in a repeating pattern so that the whole array of cube-corner elements was divided into sub-arrays. By such a variation in groove angle it has been found that the divergence profile of the sheet material can have greater rotational symmetry than sheet material in which the cube-corner elements are all orthogonal.

For cube-corner retroreflective elements as described in U.S. Pat. No. 4,588,258, the groove angles should be 88.887°, 60.640°, and 60.640° in order to form orthogonal cube-corner elements and the groove side angles should be one-half those values. If the letters "a" through "f" are used to represent different groove side angles, then the repeating pattern for the different sets of grooves can be represented as follows: For one of the sets of 60.640° grooves, the pattern was a-b-b-a-a-b-b-a, etc.; for the other set of 60.640° grooves, the pattern was a-b-a-b-b-a-b-a; and for the set of 88.887° grooves, the pattern was c-d-e-f-d-c-f-e. For the background sheeting used in the present example, the groove side angles varied from one-half the stated values according to the following table wherein the amount of deviation is stated in arc-minutes:

TABLE 2

| Groove Side Angle | Deviation |
|---|---|
| a | +2.3 |
| b | −5.0 |
| c | +2.3 |
| d | +2.3 |
| e | +2.3 |
| f | −5.0 |

The spacing between the grooves was 13.948 mils for the 88.887° grooves and 16 mils for the 60.640° grooves. The base plane of the cube-corner elements of the sheetings of this example (i.e., the triangle defined by the three intersecting sets of grooves) had included angles of 70°, 55°, and 55°, which is dictated by the degree of tilting of the cube-corner elements as taught in U.S. Pat. No. 4,588,258.

For the sheeting used as the copy of this example, the array of cube-corner retroreflective elements was the same as in the background sheeting except that the spacing between the grooves was 6.974 mils for the 88.887° grooves and 8 mils for the 60.640° grooves, and the groove side angles deviated from the stated 88.887° etc., by the amounts stated in the Table 2 above multiplied by 2.

The sheetings were prepared by grooving a master, forming a nickel electroform mold, and molding sheeting from polycarbonate.

The background sheeting was overlaid with two layers of the green polymethyl methacrylate film described with reference to Sign 1 over a 20 mil thick polycarbonate cube corner film with a 1.5 mil white heat sealable polyester film bonded to the tips of the cube corners. The background had a brightness of 86 candelas/lux/square meter at 0.1°, 81.0 at 0.2°, 24 at 0.5°, and 2.2 at 1.0°.

The copy sheeting was made using a 13 mil cube corner embossed polycarbonate film with a 1.5 mil white heat-sealable polyester film bonded to the tips of the cube corners. The copy had a brightness of 517 candelas/lux/square meter at 0.1°, 303 at 0.2°, 267 at 0.5°, and 68 at 1.0°.

Table 3 illustrates the relative contrast ratios for each of Comparative Sign A and Signs 1, 2, and 3 at an observation angle of 0.1° which corresponds to an observation distance within the conspicuity zone for signs of this configuration, and at an observation angle of 0.5° which corresponds to an observation distance within the legibility zone for signs of this configuration.

TABLE 3

| Sign | | Observation Angle 0.1° | Observation Angle 0.5° |
|---|---|---|---|
| A | Legend[2] | 362 | 137 |
| | Background[2] | 69 | 24 |
| | Ratio | 5.2 | 5.7 |
| 1 | Legend[2] | 362 | 137 |
| | Background[2] | 86 | 11 |
| | Ratio | 4.2 | 12.4 |
| 2 | Legend[2] | 362 | 137 |
| | Background[2] | 149 | 18 |
| | Ratio | 2.4 | 7.6 |
| 3 | Legend[2] | 517 | 267 |
| | Background[2] | 86 | 24 |
| | Ratio | 6.0 | 11.1 |

[2]Brightness in candelas/lux/square meter.

The results of Example 1 were as as follows. All 11 individuals assessed Sign 1 of the invention to be more legible than Comparative Sign A, with the former being rated as having an average maximum legibility distance of 501 feet as compared to an average maximum legibility distance of 447 feet for the latter. In addition, all 11 individuals assessed Sign 1 to be brighter than Comparative Sign A when viewed from a distance of 1200 feet, which corresponds to an observation angle of 0.1° or less.

The results of Example 2 were as follows. Sign 2 was assessed to be more legible than Comparative Sign A by nine of the 11 viewers, with average maximum legibility distance ratings of 500 feet as compared to 452 feet. All 11 individuals judged Sign 2 to be brighter than Comparative Sign A from a distance of 1200 feet.

The results of Experiment 3 were as follows. Sign 3 was assessed to be more legible than Comparative Sign A by ten of the 11 viewers, with average maximum legibility distance ratings of 500 feet and 456 feet being assessed. All 11 individuals judged Sign 3 to be brighter than Comparative Sign A from a distance of 1200 feet.

According to these results, Signs 1, 2, and 3, which are illustrative embodiments of this invention, each had both higher conspicuity and higher legibility than Comparative Sign A.

Various modifications and alterations of this invention will become apparent to those skilled in the art without departing from the scope and spirit of this invention.

What is claimed is:

1. A sign comprising a retroreflective background region and a retroreflective indicia region, wherein the retroreflective properties of said regions are selected such that the ratio of retroreflective brightness of said indicia to the retroreflective brightness of said background is substantially larger at locations within the legibility zone for the sign, than said ratio is at locations outside the legibility zone.

2. The sign of claim 1 wherein said ratio at observation locations within the legibility zone is at least 6:1.

3. The sign of claim 2 wherein said ratio is at least 16:1.

4. The sign of claim 1 wherein said indicia region is covered by microlens-based retroreflective sheeting.

5. The sign of claim 4 wherein said background region is covered by cube-corner-based retroreflective sheeting.

6. The sign of claim 1 wherein said background region is covered by cube-corner-based retroreflective sheeting.

7. The sign of claim 6 wherein said indicia region is covered by cube-corner-based retroreflective sheeting.

8. The sign of claim 1 wherein said indicia comprise retroreflective sheeting adhered over said background.

9. A sign comprising a retroreflective background region and a retroreflective indicia region, wherein the retroreflective properties of said regions are selected such that the ratio of retroreflective brightness of said indicia to the retroreflective brightness of said background is at least 10:1 at an observation angle of 0.5°, and said ratio is less than about 6:1 at an observation angle of 0.1°.

* * * * *

UNITED STATES PATENT AND TRADEMARK OFFICE

CERTIFICATE OF CORRECTION

PATENT NO. : 4,726,134

DATED : February 23, 1988

INVENTOR(S) : Henry L. Woltman

It is certified that error appears in the above-identified patent and that said Letters Patent is hereby corrected as shown below:

On the title page under References Cited, Defensive Publication T987,003 should be listed as a U.S. Patent Document.

In Column 2, line 38 "reletively" should be --relatively--.

In Column 7, line 26, delete "U.S. Pat. No." from the citation of the reference.

Signed and Sealed this

Eighth Day of November, 1988

*Attest:*

DONALD J. QUIGG

*Attesting Officer*

*Commissioner of Patents and Trademarks*